US009047788B2

(12) United States Patent
Koh

(10) Patent No.: US 9,047,788 B2
(45) Date of Patent: Jun. 2, 2015

(54) SECURITY SEAL

(75) Inventor: Willy Koh, Singapore (SG)

(73) Assignee: RACER TECHNOLOGY PTE LTD, Singapore (SG)

( * ) Notice: Subject to any disclaimer, the term of this patent is extended or adjusted under 35 U.S.C. 154(b) by 91 days.

(21) Appl. No.: 13/264,896

(22) PCT Filed: Dec. 31, 2009

(86) PCT No.: PCT/SG2009/000499

§ 371 (c)(1),
(2), (4) Date: Oct. 17, 2011

(87) PCT Pub. No.: WO2010/134891

PCT Pub. Date: Nov. 25, 2010

(65) Prior Publication Data

US 2012/0042482 A1 Feb. 23, 2012

(30) Foreign Application Priority Data

May 19, 2009 (SG) ..... 200903423-2

(51) Int. Cl.
*B65D 63/14* (2006.01)
*G09F 3/03* (2006.01)

(52) U.S. Cl.
CPC ..... *G09F 3/037* (2013.01); *Y10T 29/49826* (2015.01); *Y10T 24/1498* (2015.01)

(58) Field of Classification Search
CPC ..... B65D 63/1054; B65D 63/1081; B65D 63/1036; B65D 63/1045; B65D 2563/102; B65D 2563/105
USPC .. 24/16 R, 16 PB, 17 A, 17 AP, 17 B, 30.5 P; 40/300–305, 633, 665; 292/319–321, 292/325, 307 A
See application file for complete search history.

(56) References Cited

U.S. PATENT DOCUMENTS

| | | | | | |
|---|---|---|---|---|---|
| 3,588,961 | A * | 6/1971 | Farago | 24/16 PB |
| 5,524,945 | A * | 6/1996 | Georgopoulos et al. | 292/307 A |
| 5,568,952 | A * | 10/1996 | Ruegg | 292/318 |
| 5,636,412 | A * | 6/1997 | Lodi et al. | 24/16 PB |
| 6,174,006 | B1 * | 1/2001 | Burt | 292/307 A |
| 6,328,356 | B1 * | 12/2001 | Aichmann | 292/318 |

FOREIGN PATENT DOCUMENTS

| | | | |
|---|---|---|---|
| EP | 0 676 736 | A1 | 10/1995 |
| FR | 2 632 431 | A1 | 12/1989 |
| WO | 95/27968 | A2 | 10/1995 |
| WO | 2004/044871 | A1 | 5/2004 |

* cited by examiner

*Primary Examiner* — Robert J Sandy
*Assistant Examiner* — David Upchurch
(74) *Attorney, Agent, or Firm* — Sughrue Mion, PLLC

(57) ABSTRACT

A security seal 10 comprises a strap portion 12 made of plastic and a lock portion 14 attached to the strap portion. The lock portion 14 includes a metal jaw with an aperture. In use, the strap portion 12 is guided into the lock portion 14 and pulled to provide an interference fit between the lock portion 14 and the strap portion 12. The security seal 10 deters tampering since efforts to pull the strap portion 12 will either result in snapping of the strap portion 12 or visible stress-induced damage to the strap portion 12.

16 Claims, 10 Drawing Sheets

SECURITY SEAL

CROSS REFERENCE TO RELATED APPLICATION

This application is a National Stage of International Application No. PCT/SG2009/000499 filed Dec. 31, 2009, claiming priority based on Singapore Patent Application No. 200903423-2, filed May 19, 2009, the contents of all of which are incorporated herein by reference in their entirety.

FIELD OF THE INVENTION

The present invention relates to a security seal and in particular, but not exclusively, to a tamper evident security seal.

BACKGROUND TO THE INVENTION

With the ever-present dangers of theft and terrorism, security has become a major concern in industries such as cargo and pharmaceutical transportation, retail, money handling and utilities. It has therefore become increasingly important for shippers, retailers, banks and logistics providers to protect their cargo and equipment.

One way in which some form of security can be provided is by using plastic straps, more commonly known as cable ties. Cable ties typically consist of a nylon strap with an integrated gear rack along one end, and a ratchet within a small open case at an opposite end. In use, the strap is fed into the open case such that the gear rack is engaged with the ratchet, which then allows movement of the strap further into the case but not out of the case. The ratchet accordingly prevents the strap from being withdrawn from the case and, when used to seal cargo or other equipment, provides some level of security. However, it is commonly known that a small screwdriver or a needle may be used to pry open the ratchet, which allows a non-destructive removal of the strap. This is undesirable since the seal provided by the cable tie may be removed without much effort and, more importantly, without any visible sign that the seal has been tampered with.

Due to the above shortcomings of plastic straps, reliance has been placed on more complicated and often more expensive designs. Some security seals have relied upon an all-metal construction that requires power tools for removal. The extensive use of metal, however, makes the security seal costly and difficult to handle. Other security seals rely on a detection of electrical conduction or non-conduction to detect tampering, which requires electronics in additional to extensive metal use in their design. There are also known complicated designs for security seals that release ink to indicate tampering.

SUMMARY OF THE INVENTION

The present invention is defined in the appended independent claims. Some optional features of the present invention are defined in the appended dependent claims.

In one specific expression, the present invention relates to a security seal comprising a strap portion made of plastic, and a lock portion attached to the strap portion, wherein the lock portion includes a metal jaw with an aperture configured to receive the strap portion and to provide an interference fit between the lock portion and the strap portion.

This specific expression provides a cost-effective and easy-to-use security seal since plastic is used for the strap portion rather than expensive metal straps, and since there are no complicated installation procedures—a user simply inserts the strap portion into the lock portion and pulls the strap portion until the interference fit is deemed sufficient. The absence of moving parts as such makes the seal reliable and less susceptible to damage before use. Moreover, the use of a metal jaw that allows an interference fit with the strap portion provides protection in terms of preventing access to the cargo/equipment that has been sealed, but more importantly provides a means by which attempted unauthorized access or tampering would be immediately evident and irreversible. This is achieved by the specific use and arrangement of plastic components with a metal jaw that self-locks with the plastic components such that tampering is determinable from stress-whitening or blushing caused by the metal component interacting with the plastic component, or breakage of the plastic component.

Preferably the strap portion is substantially flat and has a substantially smooth front surface and back surface. By having a substantially flat and smooth-surfaced strap, the process of guiding and pulling the strap through the aperture of the lock portion is made possible with less effort. There is also no need to ensure the 'correct' orientation of the strap before guiding the strap through the aperture as required by conventional cable ties. This saves time and simplifies the sealing operation.

Preferably the aperture is rectangular. A rectangular aperture is advantageous because the profile of the aperture will better suit a flat strap and thus provide a tighter interference fit between the strap portion and the lock portion.

Preferably the aperture is defined by free ends of angled surfaces of the metal jaw. The provision of angled surfaces in the metal jaw provides a means by which retraction of the strap portion is made more difficult. This is because the angled surfaces of the metal jaw oppose movement of the strap portion in the direction of the retraction (i.e. they are angled so as to oppose a 'pulling out' force).

Preferably the strap portion has a locating area and a gripping area, the locating area having a cross-section smaller than the aperture of the metal jaw, and the gripping area having a cross-section larger than the aperture of the metal jaw. By providing these two areas on the strap, the security seal is made more user-friendly since it is possible to place the locating area in the lock portion temporarily (e.g. to position the seal before fully engaging the seal) without risking accidental and irretrievable locking.

Preferably the gripping area has a longitudinal protrusion along an edge of the strap portion. This is advantageous as the protrusion provides an even tighter grip as it is forced through the aperture of the lock portion. The protrusion may have a uniform size or may increase in size in the direction closer to the lock portion.

Preferably a cover is provided over the metal jaw, the cover having an aperture aligned with the aperture of the metal jaw. The provision of a cover further secures the metal jaw in place and makes the metal jaw less accessible and thus less susceptible to tampering.

Preferably the lock portion comprises a lock housing that is integral with the strap portion, wherein the metal jaw and the cover are arranged inside the lock housing. This arrangement optimizes the production of the security seal since a plastic strap can be integrally moulded to have all the required plastic portions including a lock housing that is ready to receive the metal jaw.

Preferably the lock housing has walls that overlap the periphery of the cover. This arrangement allows the walls to secure the metal jaw in the lock housing, avoiding the need to resort to other more complicated methods of securing the metal jaw in the plastic strap.

Preferably the cover has a planar portion substantially the same shape as the lock housing, and has a raised planar portion on the planar portion, wherein the walls of the lock housing overlap the planar portion and leave the raised planar portion exposed. The raised planar portion acts to distance the metal jaw from the entry into the lock portion. This makes it difficult for a user to tamper with the metal jaw. The planar portion that has the same shape as the lock housing allows the cover to overlap completely the metal jaw in the lock housing, thus further securing the metal jaw. Also, the planar portion provides a convenient stop when overlapping the walls of the lock housing to overlie the cover and metal jaw.

Preferably the lock housing is on a housing base, the housing base having an aperture aligned with the aperture of the metal jaw, wherein a rear surface of the housing base includes a raised portion surrounding the aperture. The raised portion, like the raised planar portion of the cover, distances the metal jaw from the exterior of the security seal, thus reducing the likelihood of a user being able to access and tamper with the metal jaw.

Preferably the strap portion has a circular cross-section and is substantially smooth. By providing a circular cross-section with a substantially smooth surface, the strap portion is not only made easy to pull through the lock portion but is also receivable in small openings that would not normally be accessible by a flat strap portion.

Preferably the aperture is circular. This is advantageous because the profile of the aperture will better suit a strap with a circular cross-section and thus provide a tighter interference fit between the strap portion and the lock portion.

Preferably the aperture is defined by free ends of angled surfaces of the metal jaw. The provision of angled surfaces in the metal jaw provides a means by which retraction of the strap portion is made more difficult. This is because the angled surfaces of the metal jaw oppose movement of the strap portion in the direction of the retraction (i.e. they are angled so as to oppose a 'pulling out' force).

Preferably the strap portion has a locating area and a gripping area, the locating area having a diameter smaller than the aperture of the metal jaw, and the gripping area having a diameter larger than the aperture of the metal jaw. By providing these two areas, the security seal is made more user-friendly since it is possible to place the locating area in the lock portion temporarily (e.g. to position the seal before fully engaging the seal) without risking accidental and irretrievable locking.

Preferably the locating area includes annular projections. The projections serve to abut the metal jaw, allowing a more secure temporary placement of the locating area in the metal jaw without accidentally locking the seal.

Preferably the lock portion comprises a lock housing integral with the strap portion, wherein the metal jaw is arranged inside the lock housing. This arrangement optimizes the production of the security seal since a plastic strap can be integrally moulded to have all the required plastic portions including a lock housing that is ready to receive the metal jaw.

Preferably the lock housing has walls that overlap the periphery of the metal jaw. This arrangement allows the walls to secure the metal jaw in the lock housing, avoiding the need to resort to other more complicated methods of securing the metal jaw in the plastic strap.

Preferably the lock housing is on a housing base, the housing base having an aperture aligned with the aperture of the metal jaw, wherein a rear surface of the housing base includes a raised portion surrounding the aperture. The raised portion distances the metal jaw from the exterior of the security seal, thus reducing the likelihood of a user being able to access and tamper with the metal jaw.

Preferably the security seal further comprises a tag portion, wherein the lock portion is between the strap portion and the tag portion. The tag portion allows the security seal to be additionally used for tracking purposes, thus avoiding the need to provide multiple devices for security and tracking purposes.

Preferably the strap portion has a tear-away line and a grip tab adjacent the lock portion. This allows the security seal to be removed conveniently when removal is intended. By gripping the grip tab and pulling the strap portion, the security seal is allowed to tear open, allowing removal of the security seal without having to resort to using tools or brute force.

Preferably the strap portion has a plurality of prongs adjacent the lock portion. The prongs are configured to pierce certain surfaces (e.g. cloth, cardboard) of the asset/cargo being sealed so as to allow the seal to grip the surface as it is being engaged (i.e. preventing the seal from rotating with the pulling force exerted on the strap portion during the locking operation) and also to retain a preferred orientation of the security seal (e.g. for convenient viewing, scanning etc).

In another specific expression, the present invention relates to a method of forming a security seal comprising forming a plastic strap having a strap portion and a lock housing, inserting a metal jaw into the lock housing, the metal jaw including an aperture configured to receive the strap portion and to provide an interference fit with the strap portion, and securing the metal jaw in the lock housing.

Preferably forming the plastic strap comprises forming a substantially flat strap portion having a substantially smooth front surface and back surface. By having a substantially flat and smooth-surfaced strap, the process of guiding and pulling the strap through the aperture of the lock portion is made possible with less effort. There is also no need to ensure the 'correct' orientation of the strap before guiding the strap through the aperture as required by conventional cable ties. This saves time and simplifies the sealing operation.

Preferably the aperture is rectangular. A rectangular aperture is advantageous because the profile of the aperture will better suit a flat strap and thus provide a tighter interference fit between the strap portion and the lock portion.

Preferably the aperture is defined by free ends of angled surfaces of the metal jaw. The provision of angled surfaces in the metal jaw provides a means by which retraction of the strap portion is made more difficult. This is because the angled surfaces of the metal jaw oppose movement of the strap portion in the direction of the retraction (i.e. they are angled so as to oppose a 'pulling out' force).

Preferably forming the plastic strap comprises forming a locating area and a gripping area on the strap portion, the locating area having a cross-section smaller than the aperture of the metal jaw, and the gripping area having a cross-section larger than the aperture of the metal jaw. By forming these two areas on the strap, the security seal is made more user-friendly since it is possible to place the locating area in the lock portion temporarily (e.g. to position the seal before fully engaging the seal) without risking accidental and irretrievable locking.

Preferably the gripping area has a longitudinal protrusion along an edge of the strap portion. This is advantageous as the protrusion provides an even tighter grip as it is forced through the aperture of the lock portion. The protrusion may have a uniform size or may increase in size in the direction closer to the lock portion.

Preferably the method further comprises placing a cover over the metal jaw after inserting the metal jaw in the lock housing and before securing the metal jaw in the lock housing. The provision of a cover further secures the metal jaw in place and makes the metal jaw less accessible and thus less susceptible to tampering.

Preferably forming the plastic strap comprises forming walls to define the lock housing, and wherein securing the metal jaw in the lock housing comprises overlapping the walls on the periphery of the cover.

Preferably overlapping comprises hot-rolling the walls over the cover. This arrangement allows the walls to secure the metal jaw in the lock housing, avoiding the need to resort to other more complicated methods of securing the metal jaw in the plastic strap.

Preferably the cover has a planar portion substantially the same shape as the lock housing, and has a raised planar portion on the planar portion, wherein securing the metal jaw comprises hot-rolling the walls to overlap the planar portion of the cover, and leaving the raised planar portion exposed. The raised planar portion acts to distance the metal jaw from the entry into the lock portion. This makes it difficult for a user to tamper with the metal jaw. The planar portion that has the same shape as the lock housing allows the cover to overlap completely the metal jaw in the lock housing, thus further securing the metal jaw. Also, the planar portion provides a convenient stop when overlapping the walls of the lock housing to overlie the cover and metal jaw.

Preferably forming the plastic strap comprises forming the strap portion to have a circular cross-section and be substantially smooth. By providing a circular cross-section with a substantially smooth surface, the strap portion is not only made easy to pull through the lock portion but is also receivable in small openings that would not normally be accessible by a flat strap portion.

Preferably the aperture is circular. This is advantageous because the profile of the aperture will better suit a strap with a circular cross-section and thus provide a tighter interference fit between the strap portion and the lock portion.

Preferably the aperture is defined by free ends of angled surfaces of the metal jaw. The provision of angled surfaces in the metal jaw provides a means by which retraction of the strap portion is made more difficult. This is because the angled surfaces of the metal jaw oppose movement of the strap portion in the direction of the retraction (i.e. they are angled so as to oppose a 'pulling out' force).

Preferably forming the plastic strap comprises forming a locating area and a gripping area on the strap portion, the locating area having a diameter smaller than the aperture of the metal jaw, and the gripping area having a diameter larger than the aperture of the metal jaw. By providing these two areas, the security seal is made more user-friendly since it is possible to place the locating area in the lock portion temporarily (e.g. to position the seal before fully engaging the seal) without risking accidental and irretrievable locking.

Preferably forming the locating area comprises forming annular projections along the locating area. The projections serve to abut the metal jaw, allowing a more secure temporary placement of the locating area in the metal jaw without accidentally locking the seal.

Preferably forming the plastic strap comprises forming walls to define the lock housing, and wherein securing the metal jaw in the lock housing comprises overlapping the walls on the periphery of the metal jaw. In one embodiment, overlapping comprises hot-rolling the walls over the metal jaw. This allows the walls to secure the metal jaw in the lock housing, avoiding the need to resort to other more complicated methods of securing the metal jaw in the plastic strap.

Preferably forming the plastic strap includes forming a tag portion such that the lock portion is between the strap portion and the tag portion. The tag portion allows the security seal to be additionally used for tracking purposes, thus avoiding the need to provide multiple devices for security and tracking purposes.

Preferably forming the plastic strap comprises forming a tear-away line and a grip tab on the strap portion adjacent the lock portion. This allows the security seal to be removed conveniently when removal is intended. By gripping the grip tab and pulling the strap portion, the security seal is allowed to tear open, allowing removal of the security seal without having to resort to using tools or brute force.

Preferably forming the plastic strap comprises forming a plurality of prongs on the strap portion adjacent the lock portion. The prongs are configured to pierce certain surfaces (e.g. cloth, cardboard) of the asset/cargo being sealed so as to allow the seal to grip the surface as it is being engaged (i.e. preventing the seal from rotating with the pulling force exerted on the strap portion during the locking operation) and also to retain a preferred orientation of the security seal (e.g. for convenient viewing, scanning etc).

As will be apparent from the following description, preferred embodiments of the present invention provide a cost-effective and visible solution for improved security of equipment, assets and cargo, particularly against the risks of theft and terrorism. This and other related advantages will be apparent to skilled persons from the description below.

BRIEF DESCRIPTION OF THE FIGURES

Preferred embodiments of the security seal will now be described by way of example with reference to the accompanying figures in which.

DETAILED DESCRIPTION OF THE PREFERRED EMBODIMENTS

Figures 1A, 1B:
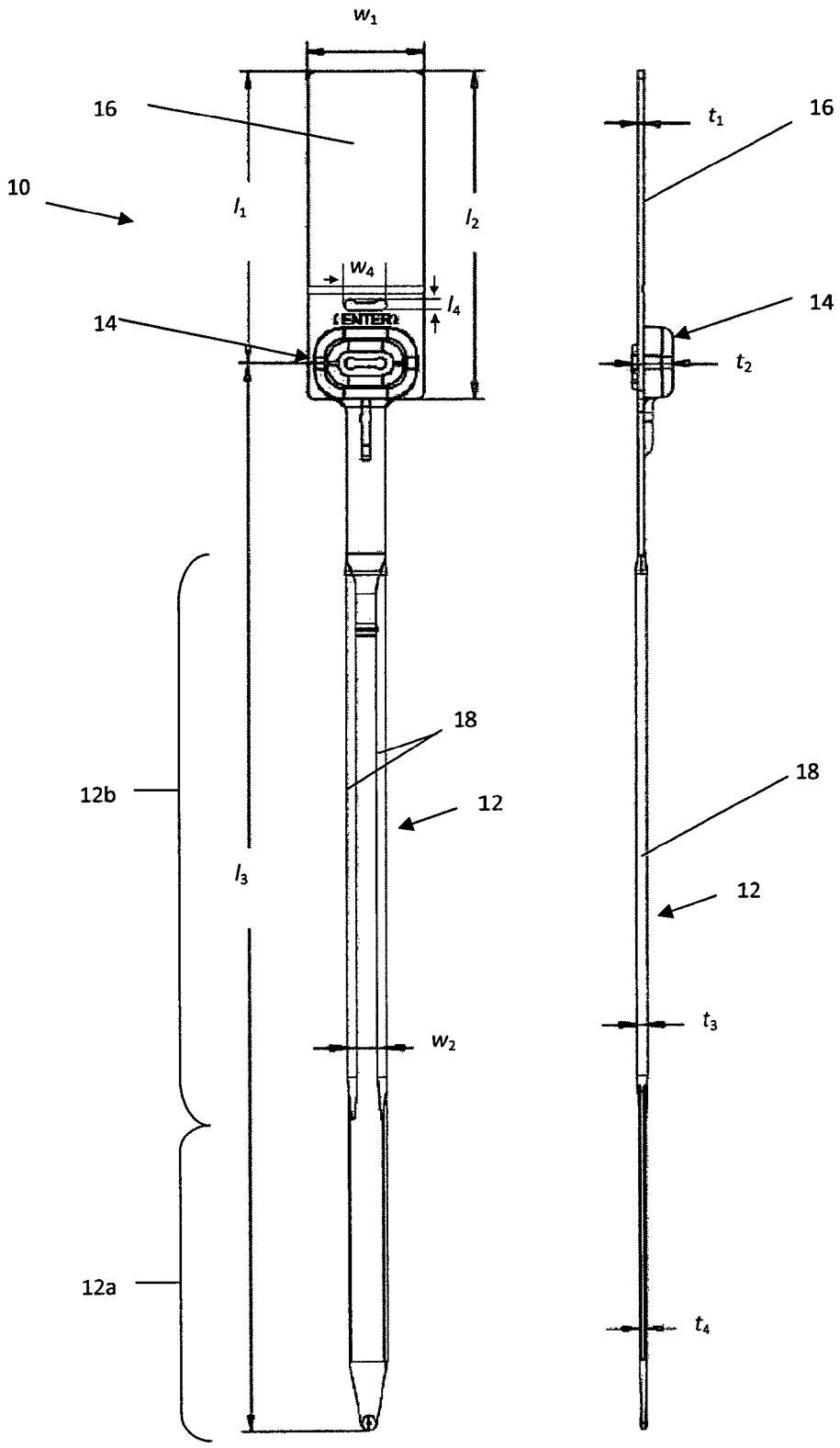
FIGS. 1A and 1B are plan and side views respectively of a first embodiment of the security seal.

FIGS. 1A and 1B show a front view and a side view of a first embodiment of the security seal 10. The seal 10 is a unitary or one-piece product that primarily comprises plastic, in particular polypropylene. At one end, the seal 10 comprises a strap portion 12. The strap portion 12 is integral with a lock portion 14 at one end thereof. At an opposite end of the lock portion 14, a tag portion 16 is provided.

The strap portion 12 is an elongate, substantially flat polypropylene strap that is tapered at its free end and is integrally connected to the lock portion 14 at an opposite end. Both front and rear surfaces of the strap portion 12 are substantially smooth (i.e. there is no gear rack as typically found in conventional cable ties) but the surfaces include two distinct areas—a locating area 12*a* for a temporary engagement with the lock portion 14, and a gripping area 12*b* for a tight engagement with the lock portion 14. The locating area 12*a* is adjacent the free end of the strap portion 12 and is substantially planar. The gripping area 12*b* is arranged between the locating area 12*a* and the lock portion 14, and includes two longitudinal protrusions or shoulders 18 along the sides or edges of the gripping area 12*b*. To provide a smooth transition between the locating area 12*a* and the gripping area 12*b*, the shoulders 18 are tapered at their ends.

The lock portion 14 comprises a housing in which a metal jaw is received. In the first embodiment, the metal jaw is substantially rectangular and defines an aperture that is substantially the same shape as, but is slightly smaller than, the cross-section of the gripping portion 12*b* of the strap portion 12. With this arrangement, a tight interference fit is made possible when the strap portion 12 is inserted into the aperture of the lock portion 14 and is pulled from the other side.

Figure 2:
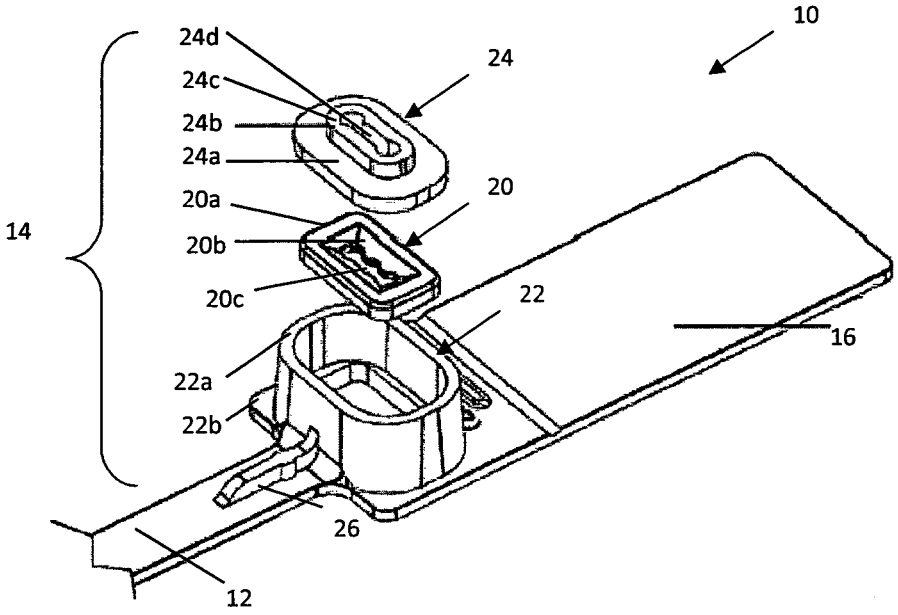
FIG. 2 is an exploded view of the lock portion and the tag portion of the first embodiment.

FIG. 2 shows an exploded view of the component parts of the lock portion 14 and in particular the metal jaw 20. The metal jaw 20 comprises a substantially rectangular frame 20*a* from which angled surfaces 20*b* extend toward but stop short of the middle of the jaw 20. The angled surfaces 20*b* extend at an acute angle (e.g. about 30°) with respect to the plane of the metal jaw 20 and are directed toward the back of the seal 10. The free ends of the angled surfaces 20*b* define the aperture 20*c* of the jaw 20.

The metal jaw 20 fits inside a lock housing 22 that is integral with the strap portion 12, and is held inside the lock housing 22 by a cover 24. The lock housing 22 comprises upstanding walls 22*a*, defining a rectangular cavity having rounded ends. The walls 22*a* are at one end integrally attached to a housing base 22*b*, and define an opening at the opposite end. The walls 22*a* are also integrally attached to the strap portion 12 via a support leg 26 for improved strength.

The cover 24 in the embodiment illustrated includes a planar portion 24*a* that has substantially the same shape as the opening of the lock housing 22. The planar portion 24*a* has a top surface and a bottom surface. The bottom surface is pressed against the metal jaw 20 when the seal 10 is assembled. A neck 24*b* extends perpendicularly from the top surface of the cover 24, defining a raised planar portion 24*c*. An aperture 24*d* extends from the raised planar portion 24*c* through the cover 24, and has substantially the same shape as the aperture 20*c* of the metal jaw 20.

Figure 3A:
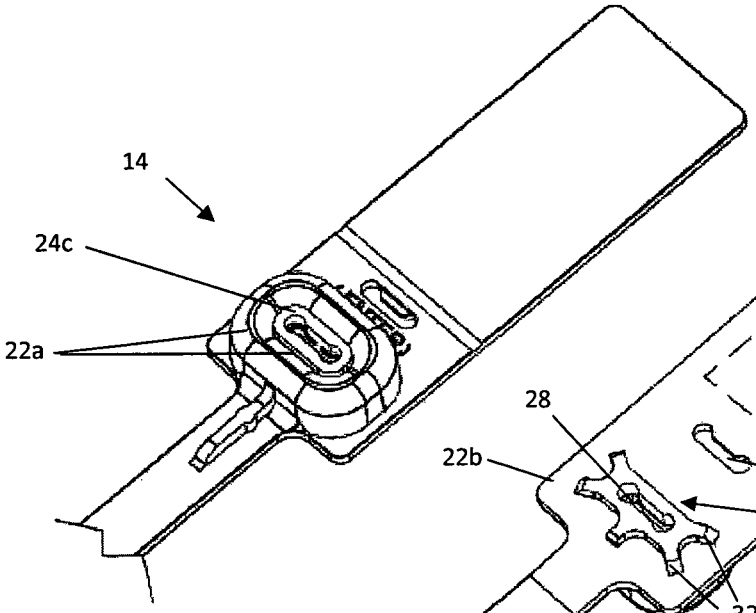
FIGS. 3A and 3B are front and back perspective views respectively of the assembled lock portion and the tag portion of the first embodiment.

FIG. 3A shows the lock portion 14 once assembled. The upper portion of the walls 22*a* of the lock housing 22 overlaps the planar portion 24*a* of the cover 24, leaving only the raised planar portion 24*c* of the cover 24 visible. The overlap secures the metal jaw 20 and the cover 24 in the lock housing 22, and additionally prevents tampering of the metal jaw 20.

Figure 3B:
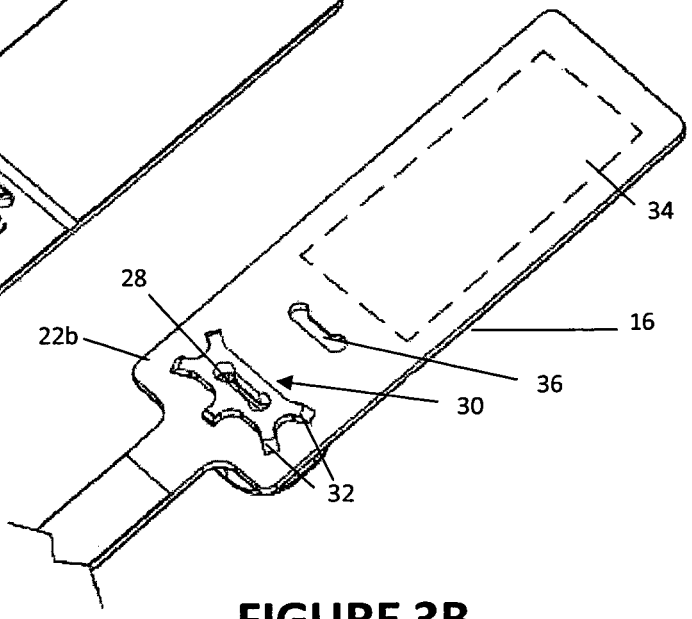

FIG. 3B shows the assembled lock portion 14 from the back. The housing base 22*b* includes an aperture 28 that is substantially aligned with the aperture 24*d* of the cover 24 and the aperture 20*c* of the jaw 20. This allows the free end of the strap portion 12 to extend through the lock portion 14 when the security seal is in use. The aperture 28 is surrounded by a raised portion 30, which serves to provide added strength (by virtue of having a plurality of supporting legs 32) and to increase the distance between the back surface of the security seal and the metal jaw inside the seal to prevent tampering.

FIG. 3B also shows the back surface of the tag portion 16. The tag portion 16 is substantially rectangular and is integrally attached to the housing base 22*b* of the lock portion 14. The area 34 surrounded in broken lines in the figure indicates the area that may be used to print required identification, tracking codes or the like. For added security, the area 34 can be heat stamped with relevant company logo, tracking numbers, barcodes etc. Alternatively the area 34 can be laser scribed (e.g. lasermark direct, tampo print lasermark) or thermal-transfer printed. Between the area 34 and the raised portion 30 is a further aperture 36, dimensioned similar to the cross-section of the gripping area 12*b* of the strap portion 12. The use of the aperture 36 for cable or strap management will be described later with reference to FIG. 4D.

Non-limiting example dimensions of the security seal of the first embodiment that have been tested are as follows (referring to FIGS. 1A and 1B). The distance $l_1$ from the centre of the lock portion 14 to the end of the tag portion 16 is about 55 mm. The distance $l_2$ from the end of the tag portion 16 to the start of the strap portion 12 is 62 mm. The distance $l_3$ from the centre of the lock portion 14 to the free end of the strap portion 12 may be chosen from: 200 mm, 260 mm, 300 mm or 350 mm. The width $w_1$ of the tag portion 16 is 22 mm. The width $w_2$ of the strap portion 12 is 7.4 mm. The thickness $t_1$ of the tag portion 16 is about 1 mm. The thickness $l_2$ of the lock portion 14 is 7.5 mm. The thickness $t_3$ of the shoulders 18 is 2 mm. The thickness $t_4$ of the locating area 12*a* is 1.2 mm. With the above dimensions, the overall length of the seal before use is one of 255 mm, 315 mm, 355 mm, 405 mm. The tag portion 16 including the lock portion 14 would be 62 mm long, 22 mm wide and 1 mm thick. The strap portion 12 would be 200 mm, 260 mm, 300 mm or 350 mm long and 7.5 mm wide. The aperture 36 has a width $w_4$ of 8 mm and a length $l_4$ of 1.45 mm. These dimensions produced a security seal having a strength (i.e. average looped pull apart force) of 50 kg or 110 lbs.

Figure 4A:
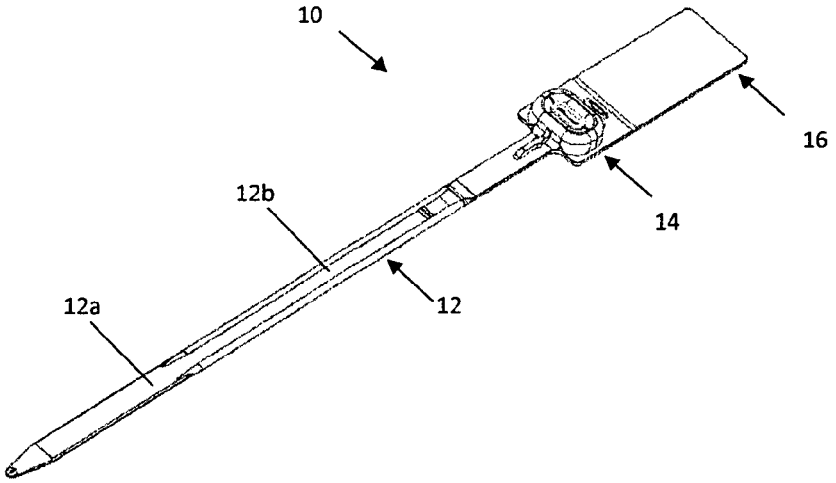
FIGS. 4A to 4D are perspective views showing the first embodiment security seal in use.
Figure 4B:
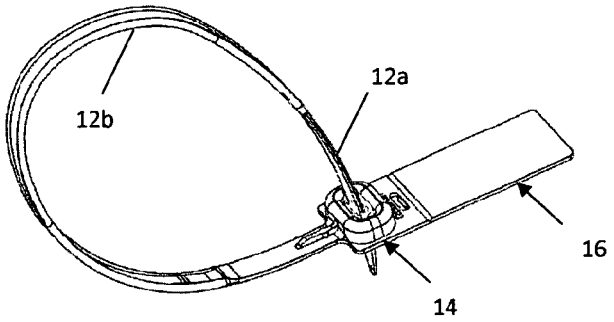
Figure 4C:
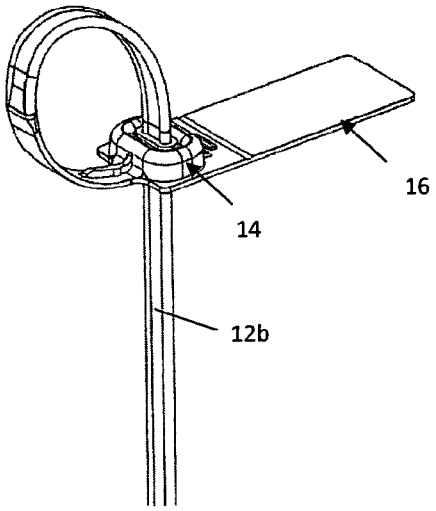
Figure 4D:
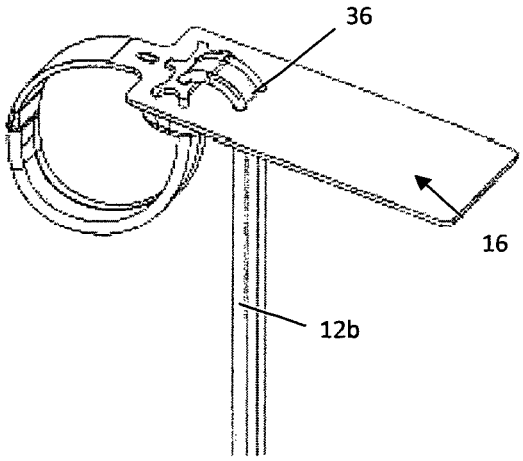

FIGS. 4A to 4D illustrate the interaction of the various portions of the security seal 10 of the first embodiment from an initial state to a sealed state. In FIG. 4A, the seal 10 is shown in its initial state, prior to being used. In this state, the locating area 12*a* and gripping area 12*b* of the strap portion 12, the lock portion 14 and the tab portion 16 are substantially in a single plane. As shown in FIG. 4B, when the seal 10 is to be used, the strap portion 12 is passed through relevant openings (not shown) of the device being sealed, and the locating area 12*a* of the strap portion 12 is inserted through the aperture of the cover, the aperture of the metal jaw and the aperture of the housing base, such that the free end protrudes from the back of the seal 10. In this state, the seal 10 is held temporarily in place (e.g. for interim positioning) and can be non-destructively removed by retracting the free end of the strap portion 12 out of the lock portion 14. No damage is suffered by the seal 10 since the locating area 12*a* is thinner than the apertures of the lock portion 14 and so does not form an interference fit with the lock portion 14. When the seal 10 is to be fully engaged, the strap portion 12 is further pulled through the lock portion 14 such that the gripping area 12*b* passes through the apertures of the lock portion 14, as shown in FIG. 4C. Because the shoulders 18 of the strap portion 12 are dimensioned larger than the aperture of the lock portion 14, the shoulders 18 form an interference fit with the metal jaw 20, resulting in a tight engagement between the strap portion 12 and the lock portion 14. In this state, there is no possibility of retracting the strap portion 12 without leaving some evidence of the retraction. If a small amount of force is used to retract the strap portion 12, the angled surfaces of the metal jaw 20 will act against the retraction since the strap movement would be opposite to the direction of the angled surfaces, and thus no retraction is possible. If a large amount of force is used to offset the gripping force between the metal jaw 20 and the strap portion 12, stress-induced whitening or 'blushing' of the plastic occurs and thus immediate tamper evidence is produced. FIG. 4D shows the insertion of the strap portion 12 through the aperture 36 for the purpose of cable or strap management.

Figures 5A, 5B, 5C, 5D:
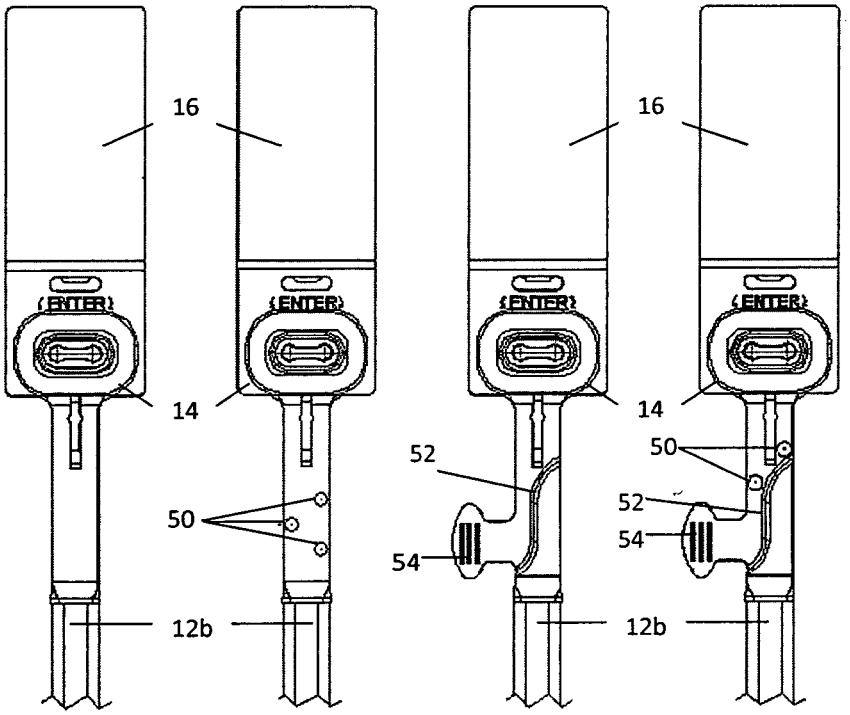
FIGS. 5A to 5D are plan views of the various configurations of the strap portion of the first embodiment.

FIGS. 5A to 5D show various configurations of the strap portion 12. FIG. 5A shows the plain configuration, where no additional features are provided between the gripping area 12*b* of the strap portion 12 and the lock portion 14. FIG. 5B shows an alternative configuration where a plurality of prongs 50 are provided. The prongs 50 serve to pierce the surface (e.g. a cloth bag) of the object to which the seal is provided to prevent slipping of the seal, and additionally to serve as further tamper indication (since they would be deformed in cases where the seal is tampered with). FIG. 5C shows a further alternative configuration where a tear-away line 52 and a grip tab 54 are provided to permit easy removal of the seal when it is decided that the seal should be removed. FIG. 5D shows a combination of the prongs 50 of FIG. 5B with the tear-away line 52 and grip tab 54 of FIG. 5C.

Figure 6A:
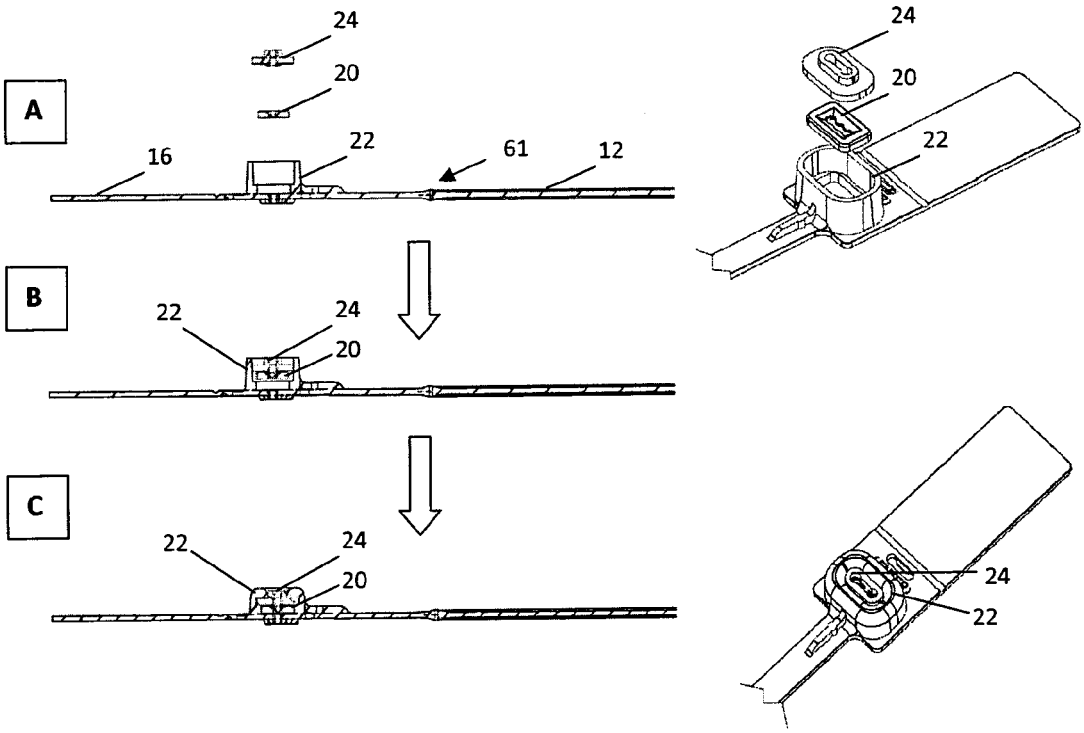
FIGS. 6A and 6B are a schematic and a flowchart respectively of the assembly of the first embodiment.
Figure 6B:
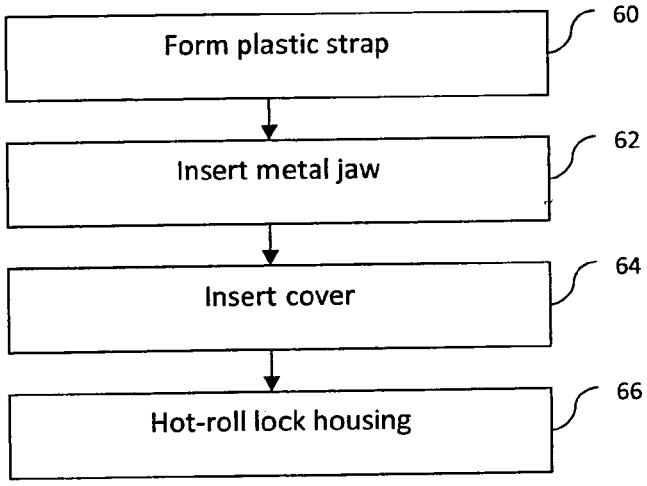

The method of fabrication of the security seal of the first embodiment will now be described with reference to the schematics of FIG. 6A and the flowchart of FIG. 6B. The method begins with the formation 60 of a plastic strap 61. As shown in part A of FIG. 6A, the plastic strap 61 comprises the strap portion 12, the lock housing 22 and the tag portion 16, integrally moulded from polypropylene. The metal jaw 20 is then inserted 62 into the lock housing 22, followed by the insertion 64 of the cover 24. This stacked assembly is shown in part B of FIG. 6A. The lock housing 22 is then hot-rolled 66 to bring its free edges over the periphery of the cover 24, securing the assembly within the lock housing 22. The assembly after hot-rolling is shown in part C of FIG. 6A.

Figures 7A, 7B:
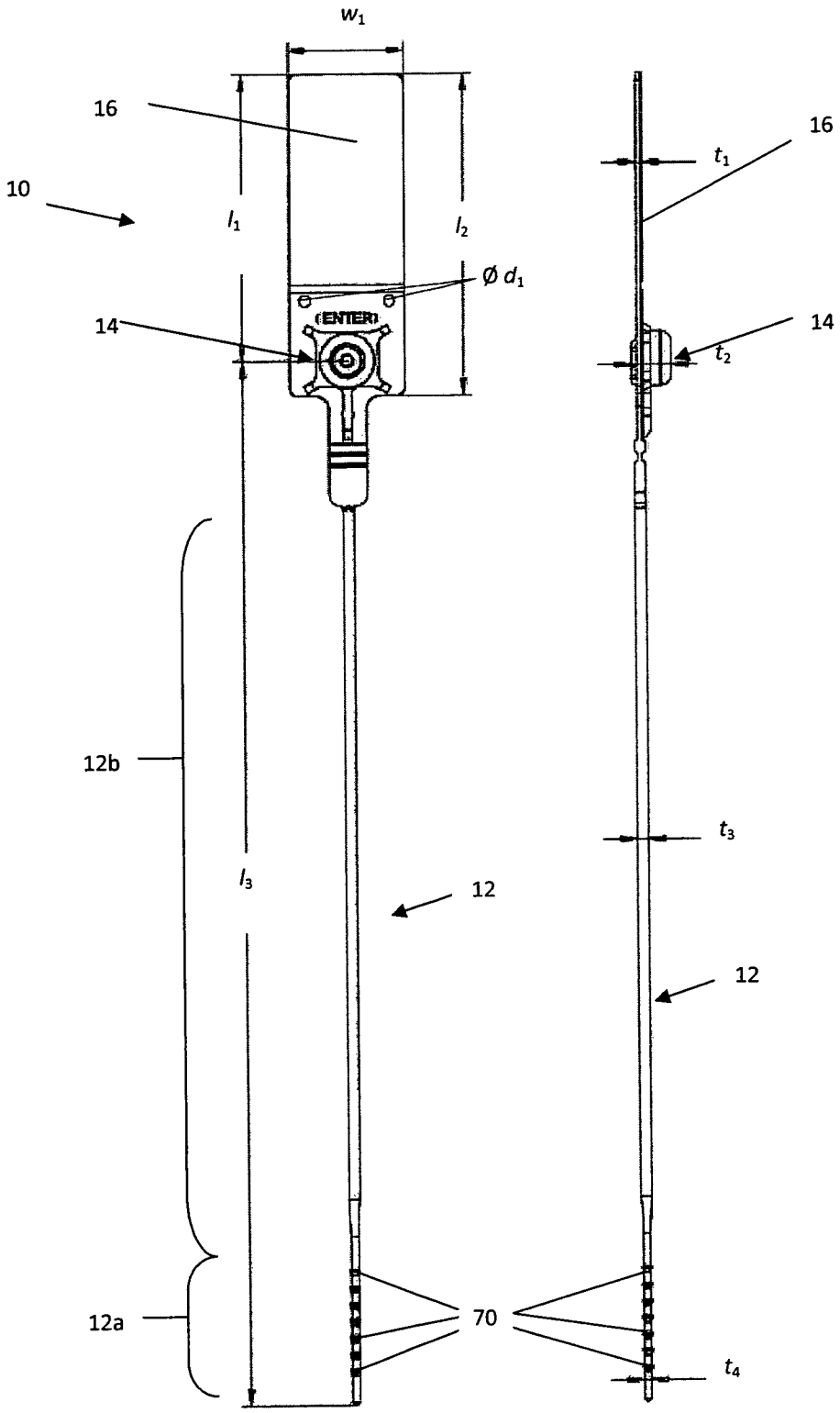
FIGS. 7A and 7B are plan and side views respectively of a second embodiment of the security seal.

A second embodiment of the security seal will now be described with reference to FIGS. 7A and 7B. The figures respectively show a front view and side view of the second embodiment security seal 10. Like the first embodiment, the second embodiment seal 10 is a one-piece product that primarily comprises plastic, in particular polypropylene. At one end, the seal 10 comprises a strap portion 12. The strap portion 12 is integral with a lock portion 14 at one end of the lock portion 14. At an opposite end of the lock portion 14, a tag portion 16 is provided.

One difference between the first and second embodiments is that the strap portion 12 of the second embodiment is not a substantially flat strap, but is instead a tail-like extension with a substantially circular cross section. This allows the second embodiment to be used in small sealing apertures that would be too small for the flat strap of the first embodiment. The surface of the tail-like extension is substantially smooth (i.e. there is no gear rack as typically found in conventional cable ties) but there are, as before, two distinct areas of the strap portion 12—a locating area 12*a* for a temporary engagement with the lock portion 14, and a gripping area 12*b* for a tight engagement with the lock portion 14. The locating area 12*a* is adjacent the free end of the strap portion 12, has a smaller diameter than the gripping area 12*b* and has annular projections 70 providing a slightly textured surface. The gripping area 12*b* is arranged between the locating area 12*a* and the lock portion 14, and is free of any projections or textures. To provide a smooth transition between the difference in diameter of the locating area 12*a* and the gripping area 12*b*, the transition between the two areas is tapered.

Like the first embodiment, the lock portion 14 comprises a housing in which a metal jaw is received. In the second embodiment, however, the metal jaw is substantially circular, as opposed to rectangular, and defines a circular aperture that is slightly smaller than the cross-section of the gripping portion 12*b* of the strap portion 12. With this arrangement, a tight interference fit is made possible when the strap portion 12 is inserted into the aperture of the lock portion 14 and is pulled from the other side.

Figure 8:
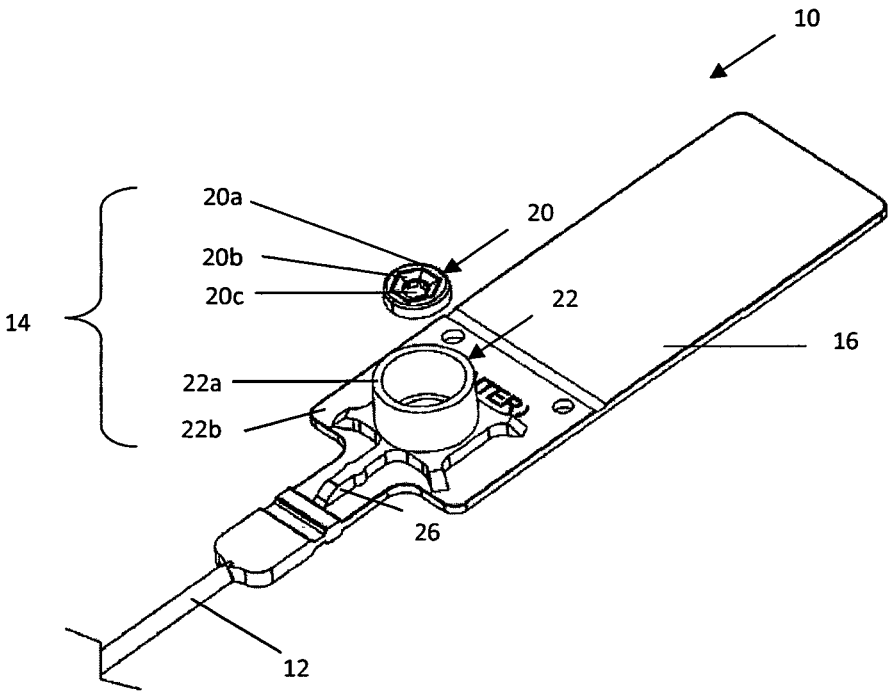
FIG. 8 is an exploded view of the lock portion and the tag portion of the second embodiment.

FIG. 8 shows an exploded view of the component parts of the lock portion 14 and in particular the metal jaw 20. The metal jaw 20 comprises a substantially circular frame 20*a* from which angled surfaces 20*b* extend toward but stop short of the middle of the jaw 20, giving the metal jaw 20 a funnel-like shape. The angled surfaces 20*b* extend at an acute angle (e.g. about 30°) with respect to the plane of the metal jaw 20 and are directed toward the back of the seal 10. The free ends of the angled surfaces 20*b* define the circular aperture 20*c* of the jaw 20.

The metal jaw 20 fits inside a lock housing 22 that is integral with the strap portion 12. Unlike the first embodiment, no cover is provided to hold the jaw 20 inside the lock housing 22. The lock housing 22 comprises upstanding walls 22*a* defining a circular cavity. The walls 22*a* are at one end integrally attached to a housing base 22*b*, and define an opening at the opposite end. The walls 22*a* are also integrally attached to the strap portion 12 via a support leg 26 for improved strength.

Figure 9A:
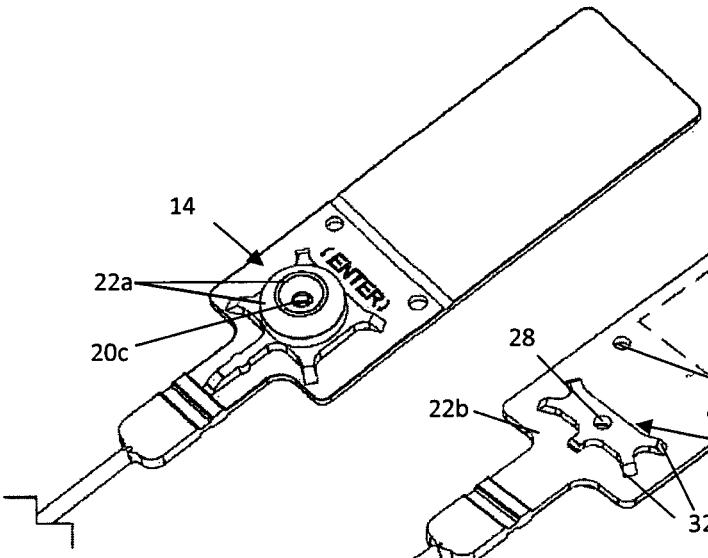
FIGS. 9A and 9B are front and back perspective views respectively of the assembled lock portion and the tag portion of the second embodiment.

FIG. 9A shows the lock portion 14 once assembled. The upper portion of the walls 22*a* of the lock housing 22 overlaps the circular frame 20*a* and the angled surfaces 20*b* of the jaw 20, leaving only the circular aperture 20*c* exposed. Like the first embodiment, the overlap in the second embodiment secures the metal jaw 20 in the lock housing 22, and additionally prevents tampering of the metal jaw 20.

Figure 9B:
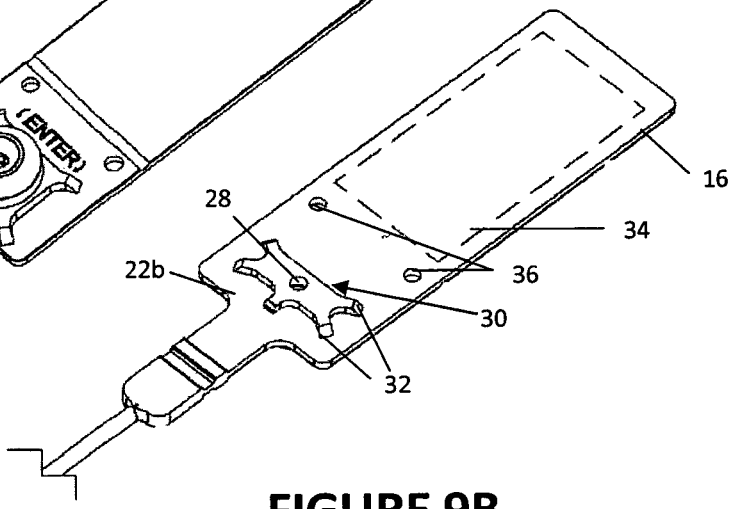

FIG. 9B shows the assembled lock portion 14 from the back. The housing base 22*b* includes a circular aperture 28 that is substantially aligned with the circular aperture 20*c* of the jaw 20. This allows the free end of the strap portion 12 to extend through the lock portion 14 when the security seal is in use. The aperture 28 is surrounded by a raised portion 30, which serves to provide added strength (by virtue of having a plurality of supporting legs 32) and to increase the distance between the back surface of the security seal and the metal jaw inside the seal to prevent tampering.

FIG. 9B also shows the back surface of the tag portion 16. The tag portion 16 is substantially rectangular and is integrally attached to the housing base 22*b* of the lock portion 14. The area 34 surrounded in broken lines in the figure indicates the area that may be used to print required identification, tracking codes or the like. For added security, the area 34 can be heat stamped with relevant company logo, tracking numbers, barcodes etc. Alternatively the area 34 can be laser scribed (e.g. lasermark direct, tampo print lasermark) or thermal-transfer printed. Between the area 34 and the raised portion 30 are two apertures 36 distanced from one another and dimensioned similar to the cross-section of the gripping area 12*b* of the strap portion 12. The use of the apertures 36 for cable or strap management will be described later with reference to FIG. 10D.

Non-limiting example dimensions of the security seal of the second embodiment that have been tested are as follows (referring to FIGS. 7A and 7B). The distance $l_1$ from the centre of the lock portion 14 to the end of the tag portion 16 is about 55 mm. The distance $l_2$ from the end of the tag portion 16 to the start of the strap portion 12 is 62 mm. The distance $l_3$ from the centre of the lock portion 14 to the free end of the strap portion 12 may be chosen from: 200 mm and 300 mm. The width $w_1$ of the tag portion 16 is 22 mm. The thickness $t_1$ of the tag portion 16 is about 1 mm. The thickness $t_2$ of the lock portion 14 is 7.5 mm. The thickness $t_3$ or the diameter of the gripping area 12*b* is 2 mm. The thickness $t_4$ or diameter of the locating area 12*a* is 1.3 mm. With the above dimensions, the overall length of the seal before use is one of 255 mm or 355 mm. The tag portion 16 including the lock portion 14 is 62 mm long, 22 mm wide and 1 mm thick. The strap portion 12 is 200 mm or 300 mm long with an upper diameter of 2 mm and a lower diameter of about 1 mm. The apertures 36 have a diameter $d_1$ of 2.1 mm. These dimensions produced a security seal having a strength (i.e. average looped pull apart force) of 16 kg or 35 lbs.

Figure 10A:
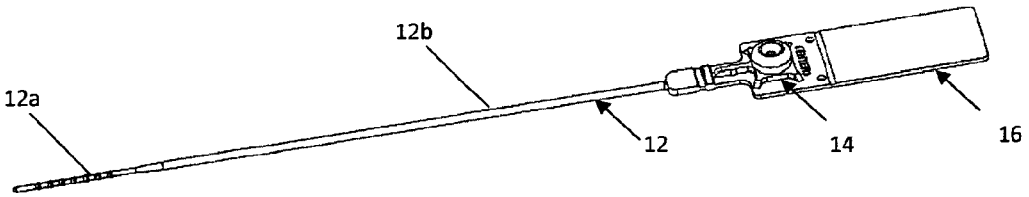
FIGS. 10A to 10D are perspective views showing the second embodiment security seal in use.
Figure 10B:
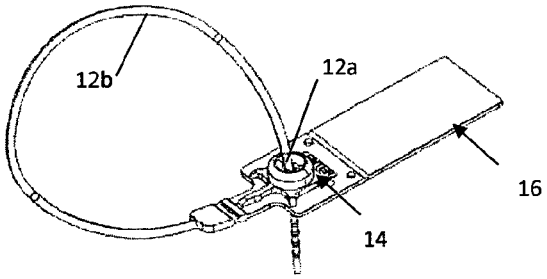
Figure 10C:
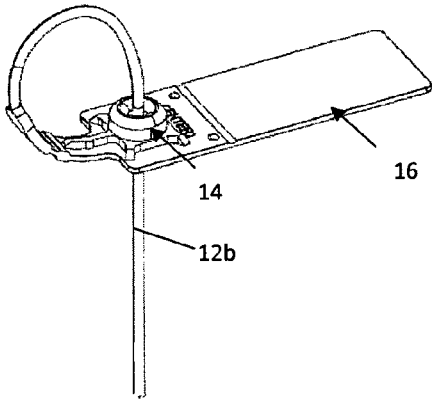
Figure 10D:
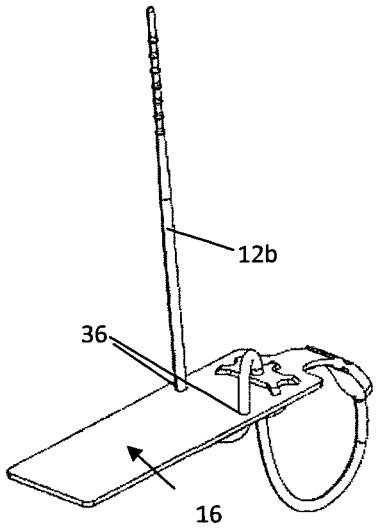

FIGS. 10A to 10D illustrate the interaction of the various portions of the security seal of the second embodiment from an initial state to a sealed state. In FIG. 10A, the seal 10 is shown in its initial state, prior to being used. In this state, the locating area 12*a* and gripping area 12*b* of the strap portion 12, the lock portion 14 and the tab portion 16 are substantially in a single plane. As shown in FIG. 10B, when the seal is to be used, the strap portion 12 is passed through relevant openings (not shown) of the device being sealed, and the locating area 12*a* of the strap portion 12 is inserted through the aperture of the metal jaw and the aperture of the housing base, such that the free end protrudes from the back of the seal 10. In this state, the seal is held temporarily in place (e.g. for interim positioning) and can be non-destructively removed by retracting the free end of the strap portion 12 out of the lock portion 14. No damage is suffered by the seal since the locating area 12*a* is thinner than the apertures of the lock portion 14 and so does not form an interference fit with the lock portion 14. When the seal is to be fully engaged, the strap portion 12 is further pulled through the lock portion 14 such that the gripping area 12*b* passes through the apertures of the lock portion 14, as shown in FIG. 10C. Because the diameter of the gripping portion 12*b* is slightly larger than that of the apertures of the lock portion 14, the gripping portion 12*b* forms an interference fit with the metal jaw 20, resulting in a tight engagement between the strap portion 12 and the lock portion 14. In this state, there is no possibility of retracting the strap portion 12 without leaving some evidence of the retraction. If a small amount of force is used to retract the strap portion 12, the angled surfaces of the metal jaw 20 will act against the retraction since the strap movement would be opposite to the direction of the angled surfaces, and thus no retraction is possible. If a large amount of force is used to offset the gripping force between the metal jaw 20 and the strap portion 12, stress-induced whitening or 'blushing' of the plastic occurs and thus immediate tamper evidence is produced. FIG. 10D shows the insertion of the strap portion 12 through the apertures 36 for the purpose of cable or strap management.

Figure 11A:
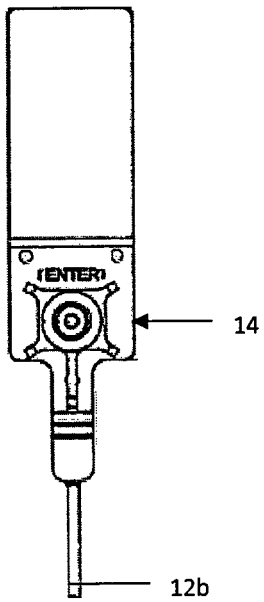
FIGS. 11A and 11B are plan views of two configurations of the strap portion of the second embodiment.
Figure 11B:
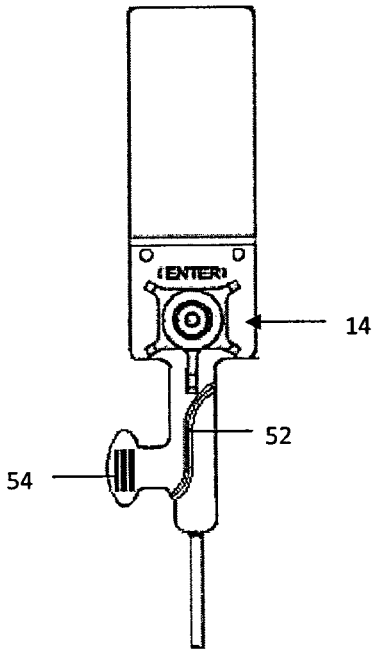

FIGS. 11A and 11B show two configurations of the strap portion 12 in the second embodiment. FIG. 11A shows a plain configuration, where no additional features are provided between the gripping area 12*b* of the strap portion 12 and the lock portion 14. FIG. 11B shows an alternative configuration similar to FIG. 5C where a tear-away line 52 and a grip tab 54 are provided to permit easy removal of the seal when it is decided that the seal should be removed.

Figure 12A:
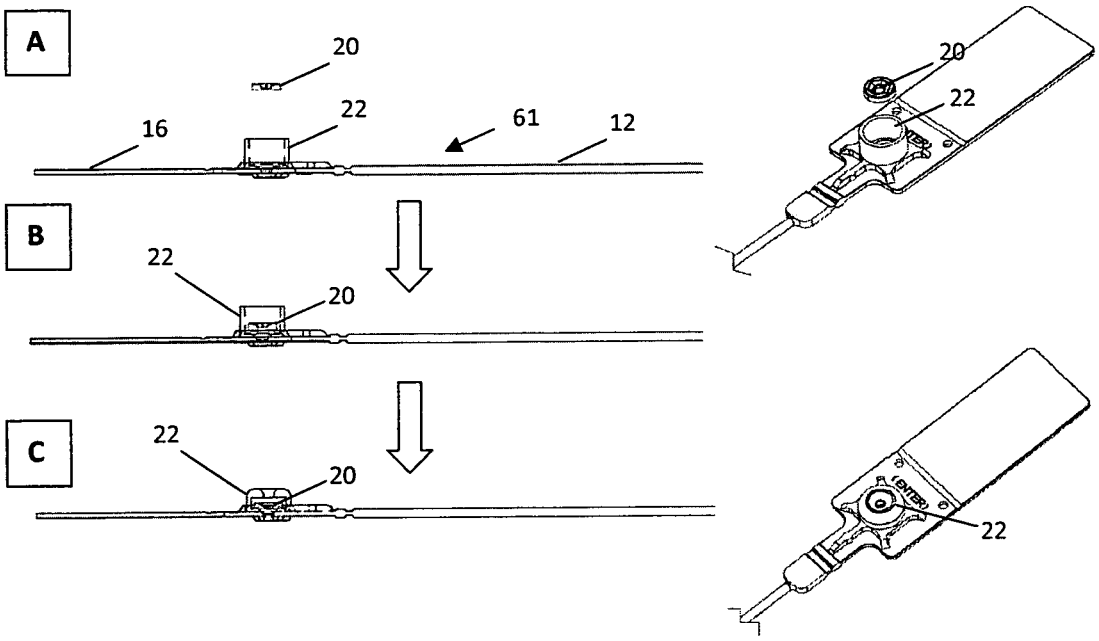
FIGS. 12A and 12B are a schematic and a flowchart respectively of the assembly of the second embodiment.
Figure 12B:
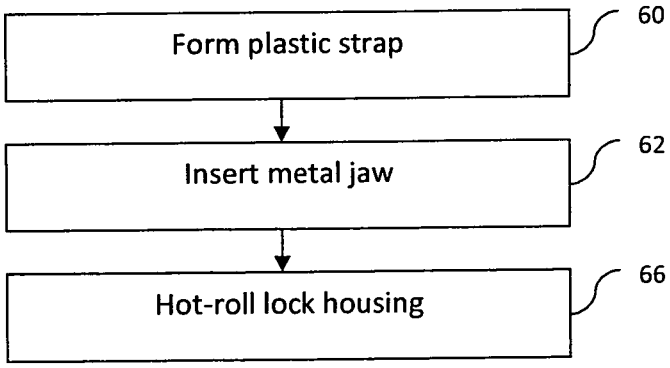

The method of fabrication of the security seal of the second embodiment will now be described with reference to the schematics of FIG. 12A and the flowchart of FIG. 12B. The method begins with the formation 60 of a plastic strap 61. As shown in part A of FIG. 12A, the plastic strap 61 comprises the strap portion 12, the lock housing 22 and the tag portion 16, integrally moulded from polypropylene. The metal jaw 20 is then inserted 62 into the lock housing 22. The placement of the jaw 20 in the lock housing 22 is shown in part B of FIG. 12A. The lock housing 22 is then hot-rolled 66 to bring its free edges over the frame and angled surfaces of the jaw 20, securing the jaw 20 within the lock housing 22. The assembly after hot-rolling is shown in part C of the FIG. 12A.

The advantages arising from the present invention will be apparent to those skilled in the art. For example, the use of plastics for most of the construction of the seal results in a seal that is cost-effective and thus can be applied generously by shippers, carriers, retailers, banks, and logistics providers to protect their cargo or assets (e.g. tote boxes, ATM cassettes, money bags, mail bags, plastic/cloth bags, inner drum bags, fibre drums, bulk tankers, trailers, valves, hatches, pouches, in-bond shipments, lockout/tagout, valves, mini-bars, liquor kits, vending machines, measuring devices, scales, tank trucks, hose tubes etc).

The security seal provides some protection in terms of preventing access to the cargo/asset that has been sealed, but more importantly provides a means by which attempted unauthorized access or tampering would be immediately evident and irreversible. This is achieved by the specific use and arrangement of plastic components with a metal jaw that self-locks with the plastic components such that tampering is determinable from either stress-whitening or blushing caused by the metal component interacting with the plastic component or breakage of the plastic component. Accordingly, a tamper-evident plastic security seal is provided that serves as a psychological deterrent since evidence of forced entry or tampering would be clearly visible and cannot be subsequently hidden or covered up. These security provisions do not, however, adversely affect the usability of the strap. To the contrary, the use of a substantially smooth strap portion makes the 'pull-up' operation (i.e. when the strap portion is inserted into the lock portion and pulled through until the two portions are tightly engaged) much easier. The operation of installing the security seal is also simple since the seal is self-locking, that is to say, the seal locks automatically as the strap portion is pulled-up. Intended removal operations are also simple. Once an asset is safely received and the seal should be removed, the asset owner may cut the plastic strap simply and quickly. Where tear-away lines and grip tabs are provided, the removal of the seal is made even simpler.

The provision of a lock housing that overlaps the metal jaw and the provision of the raised portion at the back of the seal further improve security by preventing access to the metal jaw. A user is therefore unable to pry open the metal jaw in an attempt to remove the strap without leaving tamper evidence behind. Even if the user resorts to a thin or sharp object to be inserted into the lock portion for the purpose of prying open the metal jaw, it is inevitable that the object would leave either scratch marks on or alternatively deform the plastic of the lock housing or the cover. The combination of the use of plastic in certain areas and metal in certain areas therefore not only serves to minimize fabrication cost but results in an unexpected advantage of providing further tamper indication means.

In addition to restricting access and providing tamper indication, the security seal also provides a means by which the relevant cargo or asset can be tracked. For example, by laser scribing or heat stamping barcodes, tracking codes, a company's logo etc on the tag portion, tracking is made simple. The tag portion can also be used to designate specific uses of the security seal (e.g. green coloured seals that are specific for ATM cassettes from one location).

The foregoing describes preferred embodiments, which, as will be understood by those skilled in the art, may be subject to variations or modifications in design, construction or operation without departing from the scope of the claims.

The invention claimed is:

1. A security seal comprising:

a strap portion made of plastic, and a lock portion attached to the strap portion, wherein the lock portion includes a metal jaw with an aperture configured to receive the strap portion and to provide an interference fit between the lock portion and the strap portion, wherein the lock portion comprises a lock housing that is integral with the strap portion, wherein the metal jaw is arranged inside the lock housing, wherein a cover is provided over the metal jaw, the cover having an aperture aligned with the aperture of the metal jaw, wherein the cover is arranged inside the lock housing, and wherein the lock housing has walls that overlap the periphery of the cover, wherein the cover has a planar portion substantially the same shape as the lock housing, and has a raised planar portion on the planar portion, wherein the walls of the lock housing overlap the planar portion and leave the raised planar portion exposed, and wherein the cover includes a neck portion protruding from the planar portion providing a stop for tips of upper portions of the overlapped walls of the lock housing.

2. The security seal of claim 1, wherein the strap portion is substantially flat and has a substantially smooth front surface and back surface, and wherein the aperture is rectangular.

3. The security seal of claim 1, wherein the aperture is defined by free ends of angled surfaces of the metal jaw.

4. The security seal of claim 1, wherein the strap portion has a locating area and a gripping area, the locating area having a cross-section smaller than the aperture of the metal jaw, and the gripping area having a cross-section larger than the aperture of the metal jaw.

5. The security seal of claim 4, wherein the gripping area has a longitudinal protrusion along an edge of the strap portion.

6. The security seal of claim 1, wherein the lock housing is on a housing base, the housing base having an aperture aligned with the aperture of the metal jaw, wherein a rear surface of the housing base includes a raised portion surrounding the aperture.

7. The security seal of claim 1, wherein the strap portion has a circular cross-section and is substantially smooth, and wherein the aperture is circular.

8. The security seal of claim 4, wherein the locating area includes annular projections.

9. The security seal of claim 1, wherein the lock housing has walls that overlap the periphery of the metal jaw.

10. The security seal of claim 1, further comprising a tag portion, wherein the lock portion is between the strap portion and the tag portion.

11. The security seal of claim 1, wherein the strap portion has a tear-away line and a grip tab adjacent the lock portion.

12. The security seal of claim 1, wherein the strap portion has a plurality of prongs adjacent the lock portion.

13. A method of forming a security seal comprising:

forming a plastic strap having a strap portion and a lock housing, inserting a metal jaw into the lock housing, the metal jaw including an aperture configured to receive the strap portion and to provide an interference fit with the strap portion, securing the metal jaw in the lock housing, placing a cover over the metal jaw after inserting the metal jaw in the lock housing and before securing the metal jaw in the lock housing, wherein forming the plastic strap comprises forming walls to define the lock housing, wherein securing the metal jaw in the lock housing comprises overlapping the walls on the periphery of the cover, wherein overlapping comprises hot-rolling the walls over the cover, wherein the cover has a planar portion substantially the same shape as the lock housing, and has a raised planar portion on the planar portion, wherein the walls of the lock housing overlap the planar portion and leave the raised planar portion exposed, and wherein the cover includes a neck portion protruding from the planar portion providing a stop for tips of upper portions of the overlapped walls of the lock housing.

14. The method of claim 13, wherein forming the plastic strap comprises forming a locating area and a gripping area on the strap portion, the locating area having a cross-section smaller than the aperture of the metal jaw, and the gripping area having a cross-section larger than the aperture of the metal jaw.

15. The method of claim 13, wherein the cover has a planar portion substantially the same shape as the lock housing, and has a raised planar portion on the planar portion, wherein securing the metal jaw comprises hot-rolling the walls to overlap the planar portion of the cover, and leaving the raised planar portion exposed.

16. The method of claim 13, wherein forming the plastic strap comprises forming walls to define the lock housing, wherein securing the metal jaw in the lock housing comprises overlapping the walls on the periphery of the metal jaw, and wherein overlapping comprises hot-rolling the walls over the metal jaw.

* * * * *